United States Patent [19]

Nemet

[11] Patent Number: 4,521,784

[45] Date of Patent: Jun. 4, 1985

[54] GROUND-PLANE ANTENNA WITH IMPEDANCE MATCHING

[75] Inventor: Mihaly Nemet, Budapest, Hungary

[73] Assignee: Budapesti Radiotechnikai Gyar, Hungary

[21] Appl. No.: 416,702

[22] Filed: Sep. 10, 1982

[30] Foreign Application Priority Data

Sep. 23, 1981 [HU] Hungary ..... 2744/81

[51] Int. Cl.[3] ..... H01Q 1/48

[52] U.S. Cl. ..... 343/846; 343/862

[58] Field of Search ..... 343/846, 790, 791

[56] References Cited

U.S. PATENT DOCUMENTS 2,184,729 1/1939 Bailey ..... 343/846

4,095,231 4/1978 Carter ..... 343/846

FOREIGN PATENT DOCUMENTS 934672 3/1963 United Kingdom ..... 343/792

OTHER PUBLICATIONS

Amateur Radio Handbook: Hooton, Howard W. Sams Co., Inc., May 1962, pp. 75–81.

*Primary Examiner*—E. Lieberman

*Assistant Examiner*—K. Ohralik

*Attorney, Agent, or Firm*—McGlew and Tuttle

[57] ABSTRACT

An improved ground-plane antenna with a quarterwave resonant radiating rod (1) made of a hollow tube in which a central earthing rod (7) is arranged to form with the internal cylindrical wall of the radiating rod a line section short-circuited at the upper end, and a further line section (16) open at the lower end is arranged in the extension of the short-circuited line section to form a combined tapped line section therewith having an electrical length substantially equal to the quarter-wavelength, in which the combined line section is coupled with its tapping points in parallel to the input terminals of the antenna, whereby the susceptance represented by the combined line section is capable of compensating the changes of the antenna reactance within a fairly wide band.

5 Claims, 3 Drawing Figures

GROUND-PLANE ANTENNA WITH IMPEDANCE MATCHING

The invention relates to a ground-plane antenna with a resonant quarterwave radiator extending vertically above an earthing plane, which comprises a pair of input terminals arranged between the earthing plane and the lower end of the radiator rod, and such that a short-circuited transmission line is connected across the input terminals.

Ground-plane antennas are widely used in telecommunication technique, particularly in the frequency range between 20 to 200 MHz. Ground-plane antennas comprise vertical quarterwave radiators arranged to radiate in a hemisphere above an actual or virtual ground plane. The gain of such antennas is 0 dB. The radiator rod is usually fed at its base point and it is matched to a coaxial line.

The radiator rod of the classical ground-plane antenna is isolated from the ground and this location provides a DC insulation as well. In such designs the radiator rod tends to get electrostatically charged, and the protection against lightning hazards towards the electronic devices coupled to the antenna is not sufficiently safe. The DC earthing of the radiator rod is achieved conveniently by using a folded unipol as a radiator, which apart from earthing the antenna has an increased base-point impedance. The folded unipol, although it provides a DC earthing, can not offer a safe protection against lightning damages, because the length of the antenna is more than ten times higher than the distance between the two parallel rods, and thus a flashover might occur at the antenna base. During a lightning hit the current flowing in the two parallel rod sections can be extremely high accompanied with a dynamical effect thay may deform and damage the antenna.

It has been proposed first by M. G. Brown (U.S. Pat. No. 2,275,342) the antenna should be connected to the ground through a short-circuited line section. In this proposal the electrical length of the short-circuited line-section is equal to the quarterwave and it extends vertically below the radiator rod. The presence of the line-section exerts an influence on the base-point impedance of the antenna by which the bandwidth increases by a negligable extent only.

The bandwidth of ground-plane antennas is determined dominantly by the construction of the counterweight rods by which the earthing plane is imitated and by the slenderness of the radiator rod. The bandwidth can be increased by increasing the diameter of the radiating rod, but the corresponding function is logarithmical and a small increase in bandwidth requires a substantial increase in diameter. The relative bandwidth of currently used ground-plane antennas is between about 1 to 3%.

When mechanical design is considered, it should be pointed out that the radiator rod is supported generally by an insulator. For decreasing the base point capacitance to earth, insulators are used which are exposed to an excessive bending moment. The strength of insulator materials against a bending moment is rather limited, the materials are stiff and rigid which explains why the design of an appropriate support forms a critical factor in the whole design work.

The increase in the required bandwidth of telecommunication connections necessitates the usage of antennas with as high relative bandwidths as 5 to 10%, wherefrom it follows that in spite of all preferable features conventional ground-plane antennas are not suitable for such applications.

The object of the invention is to provide an improved ground-plane antenna capable for operating in such wide bands and for eliminating the above summarized drawbacks of conventional types of ground-plane antennas.

The invention is based on the recognition that a short-circuited line section can be arranged within the radiator rod if it is made by a hollow tube, and an open line section can be used as an extension of the first line section. The two line sections together can be considered as a tapped line open at one end and short-circuited at its other end. The feeding or input points of the antenna are coupled to the tapping points of that combined line. By appropriately selecting the position of the tapping points, the magnitude and the frequency characteristics of the electrical susceptance represented by the combined line can compensate the base-point susceptance of the antenna within a wide frequency range, whereby the antenna will have a favourable standing wave ratio within a greater bandwidth.

According to the invention an improved ground-plane antenna has been provided with a resonant quarterwave radiator rod extending vertically upwards from an earthing plane, which comprises a pair of input terminals arranged between the earthing plane and the lower end of the radiator rod, with a short-circuited line section coupled in parallel to the input terminals, and the improvement lies in that the line section with a short-circuit at one end thereof is made by an earthing rod extending concentrically within the radiating rod and a short-circuiting member is coupled both to an end portion of the earthing rod and to the internal wall of the radiating rod, and a further line secton with an open end is coupled to the input terminals arranged as an extension of the first line section.

In a preferable embodiment the lower end of the radiating rod is connected both to the inner conductor of the feeding line and to the inner conductor of the open line section, and the outer conductors of the feeding line and of the open line section are connected to the lower end of the earthing rod and to the earthing plane.

The combined electrical length of the short-circuited and open line sections is equal to the quarterwavelength within a tolerance range of $\pm 25\%$. It is preferable if the open line section is made by a section of a coaxial cable.

It is preferable for the mechanical construction if the ground-plane antenna according to the invention comprises an antenna head made of a metal which defines a central bore with a shoulder, a mounting disk abutting to the shoulder is arranged in the bore and connected to the outer shield of the feeding cable and of the open line section, the centre region of the mounting disk is coupled to the lower end of the earthing rod, the mounting disk is isolated from the radiating rod by means of a spacing sleeve of insulating material, a clamp is arranged around the lower end portion of the radiating rod to provide connections to the inner conductors of the feeding cable and of the open line section, and a support sleeve is arranged in the central bore of the antenna head to provide support for the radiating rod.

For the sake of increased lightning protection it is preferable if the upper end of the support sleeve extends over the upper face of the antenna head and a ring is attached to the radiating rod just above the end of the support sleeve to form a spark gap with said upper face.

The ground-plane antenna made in accordance with the principles described hereinabove has a bandwidth being about five-times broader than that of conventional ground-plane antennas, it has preferable out-of-band properties, and it offers an improved protection against lightning. The constructional design of the ground-plane antenna according to the invention is simple, it is surprisingly slender compared to its broad bandwidth and it has an improved reliability.

The improved ground-plane antenna according to the invention will now be described in connection with exemplary embodiments thereof, in which reference will be made to the accompanying drawings. In the drawing.

Figure 1:
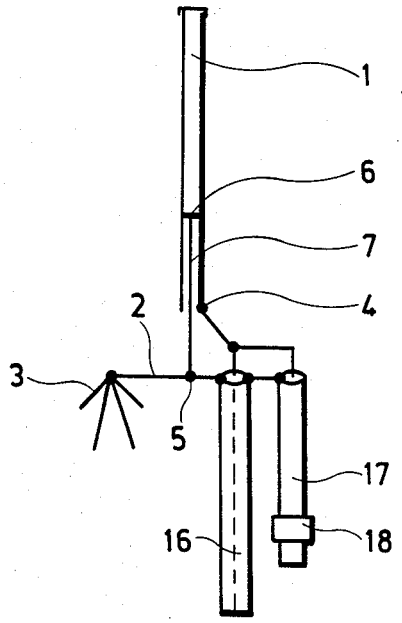
FIG. 1 shows schematically an embodiment of the ground-plane antenna according to the invention in which a distorted longitudinal scale has been used in the region of the antenna base for facilitating the understanding.

The ground-plane antenna shown in FIG. 1 comprises a vertical radiating rod 1 made of a metal tube and having a length approximately equal to the quarter-wavelength. The radiating rod 1 is arranged above an actual or virtual earthing plane 2. In the embodiment of FIG. 1 the earthing plane 2 is created by the effect of four counterweight rods 3 slanting downwards and having lengths substantially equal to the quarter-wavelength.

The antenna has a pair of input terminals 4 and 5 of which input terminal 4 is connected to the lower (warm) end of the radiating rod 1, to the central conductor of feed line 17 and to the central conductor of line section 16 open at its end. The other input terminal 5 is connected to the earthing plane, to the outer shielding of the feed line 17, to the outer shielding of the open line section 16 at the upper end thereof and to lower end of an earthing rod 7 extending axially in the centre line of the radiating rod 1. The upper end of the earthing rod 7 is coupled through a short-circuiting member 6 to the inner wall of the radiating rod 1 which is made by a hollow tube.

The earthing rod 7 together with the short-circuiting member 6 and with the cylindrical internal wall of the radiating rod 1 form a short-circuited line section shorter than the quarterwavelength and open at its lower end, and in conjunction therewith the open line section 16 is arranged as an actual or virtual extension of the short-circuited line section. The electrical length of the open line section 16 is also shorter than the quarter-wavelength and the line section 16 can be made preferably by a portion of a coaxial cable.

The line section extending in the radiating rod 1 which is short-circuited at its upper end when considered together with the open line section 16 connected thereto can be regarded as a single combined line section short-circuited at the upper end and open at the bottom. This combined line section has a tapping in the height of the earthing plane 2, and at this tapping the combined line section is connected in parallel to the input terminals 4 and 5 of the antenna.

The presence of this tapped line section exerts a substantial influence on the properties of the ground-plane antenna. At the tapping points the line section represents practically a pure susceptance which is added to the reactive component of the base-point admittance of the antenna.

The susceptance of the line section at the tapping points changes with the frequency and the steepness of this changing depends on the position of the tapping points in the line section, while the magnitude of the susceptance depends on the full length of the line section and on the capacitance represented by the antenna base determined by the mounting stray capacitances. The length of the combined line section is near to the quarterwavelength, and the position of the tapping points can be adjusted by the simultaneous adjustment of the position of the short-circuiting member 6 and of the length of the open line section 16 during which the length of the combined line section should remain substantially constant.

It has been experienced that with a suitable position of the tapping points the susceptance represented by the combined line section can compensate the changes of the reactive component of the antenna base-point impedance within a relatively broad frequency band, whereby the standing wave ratio of the antenna will be rather good within a broad band.

The antenna will have an increased operational bandwidth; the presence of the tapped line section, however, represents a high susceptance outside the operational band which practically short-circuits the antenna. This effect is favourable because thereby the input of a receiver coupled to the antenna will be protected from disturbing high-level signals received out of the operational band, or it effectively rejects the radiation of spurious signals of a transmitter if it is coupled to the antenna.

Owing to the usage of the combined line section there will be a galvanical connection between the radiating rod 1 and the earth-potential, whereby the static charging of the antenna is prevented. Unlike the folded unipol antennas the earthing rod 7 is arranged in a shielded way within the radiating rod 1, and the dynamical effect of a lightning hit can not cause a great damage in the antenna structure.

Figure 3:
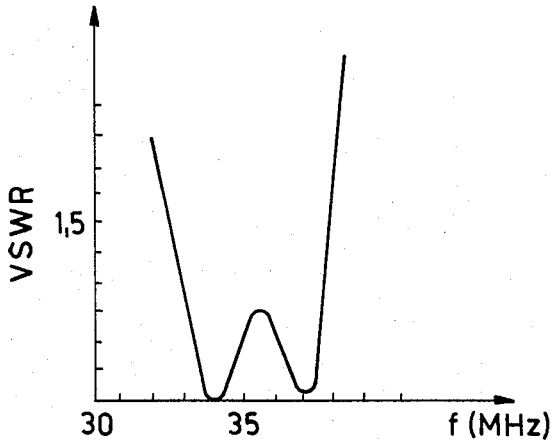
FIG. 3 shows the standing wave ratio versus frequency curve of the embodiment shown in FIG. 2.

FIG. 3 shows the standing wave ratio versus frequency curve of an antenna designed according to the invention to operate between 33 and 38 MHz, and the curve shows that the standing wave ratio of the antenna is better than 1.5 in a band of 5 MHz which represents a relative bandwidth of 14%. This bandwidth is about five times higher than that of conventional ground-plane antennas.

In addition to the increased bandwidth, the galvanically earthed radiator and the favourable out of band properties, the antenna according to the invention has several other preferable features which will be described in connection with an exemplary embodiment shown in FIG. 2.

In this embodiment the assembly is held by an antenna head 11 made of a metal in which threaded bolts with skew axis are tooled for receiving the counterweight rods 3. A central bore open from the bottom is defined in the antenna head and a shoulder is made in the bore. A metal mounting disk 14 abuts to the shoulder which is attached thereto by threaded bolts, and the mounting disk 14 is electrically connected to the lower end of the earthing rod 7. The lower end of the radiating rod 1 is insulated from the mounting disk 14 by means of a spacing sleeve 13 made of an insulating material.

A support sleeve 10 is arranged in the upper portion of the central bore of the antenna head 11 and its upper end extends over the face of the antenna head 11 by about 2 mm-s. The radiating rod 1 is lead through the central bore of the support sleeve 10 and this latter acts as a mechanical support for the radiating rod 1. It can be seen that the support sleeve 10 is exposed to pressure load only when a bending moment acts on the radiating rod 1 due to wind load. Insulator materials easily stand such kind of load. The usage of the insulator sleeve exposed to pressure load only, represents a significant improvement compared to conventional insulators exposed mainly to bending stresses.

Although the support sleeve 10 induces a higher capacitance in the antenna base than the conventional insulators designed to bending load, its presence will not be disturbing in the embodiment according to the invention because the susceptance of the combined line section can compensate this induced capacitance.

The upper ends of the open line section 16 and of the feed line 17 are both connected to the mounting disk 14 in such a way that the shieldings of these cables are coupled to the mounting disk 14 by means of respective cable grips 15*a* and 15*b*. The central conductors of these cables are both connected to a clamp 12 mounted around the lower end portion of the radiating rod 1. An asymmetrical connector socket 18 is mounted on the lower end of the feed line 17 for the releasable connection of the antenna cable. The lower end of the open line section 16 is closed and protected by a rubber cap 19.

An annular gap arrester 9 is fixed on the radiating rod 1 which abuts the upper face of the support sleeve 10 and located opposingly relative to the annular upper face of the antenna head 11. The spark-gap therebetween ensures an effective lightning protection. With the constructional design shown in FIG. 2 the feed line 17 is sufficiently protected from the detrimental effects of a lightning hit.

The lower portion of the outer part of the radiating rod 1 is sealed by a bell 8 preventing the space above the mounting disk 14 from inflowing water and humidity. It is advisable, however, to fill this space with a resin. Cap 21 is used to close the upper end of the radiating rod 1.

Figure 2:
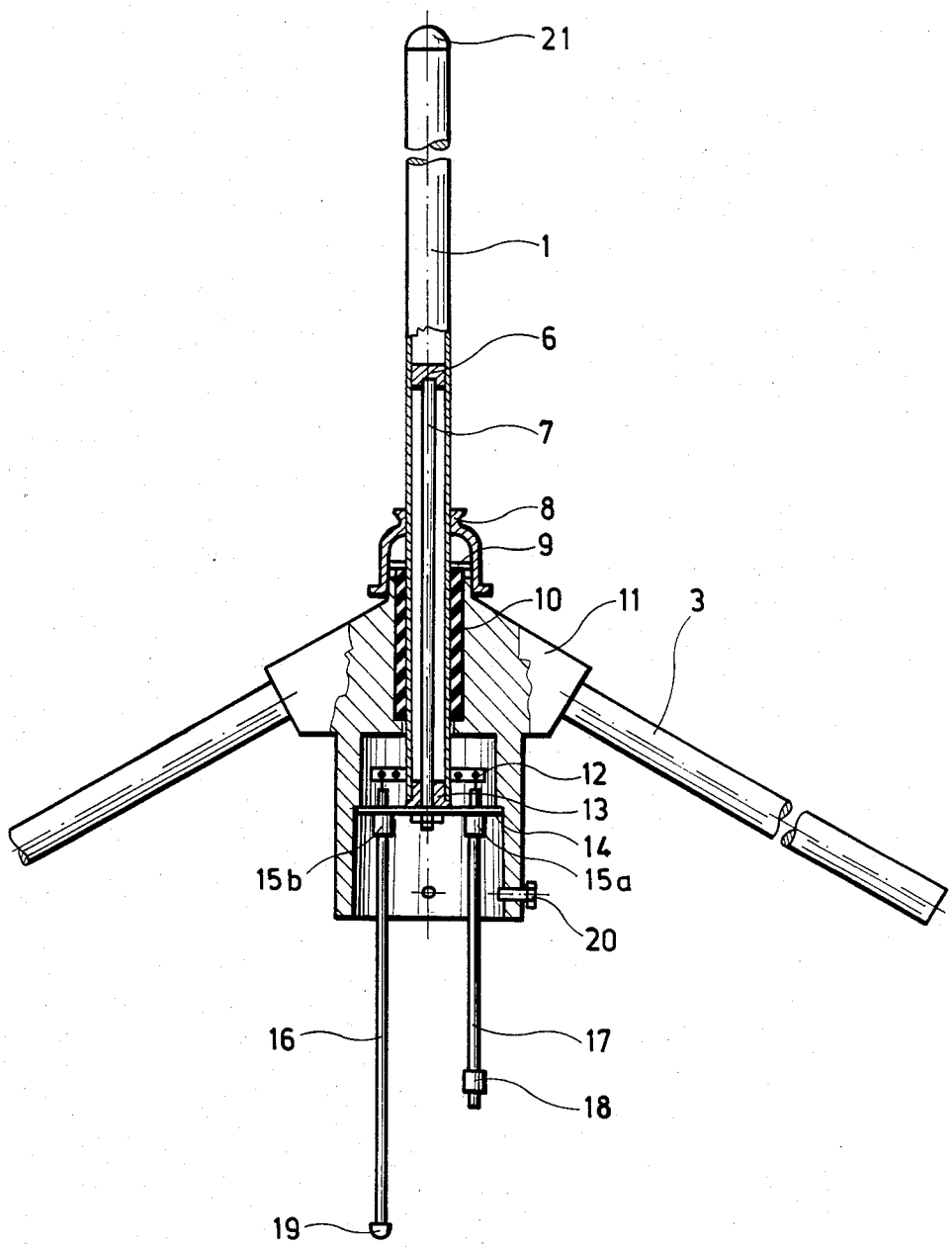
FIG. 2 shows the elevation view of a further embodiment partly in section.

The constructional design shown in FIG. 2 is preferable for the assembly of the antenna, because the mounting disk 14 together with the associated cable sections and the radiating rod 1 can be assembled separately to form a prefabricated product. The antenna head 11 is designed for easy mounting onto the top of an antenna mast and it can be fixed by a pair of bolts 20. The feeding line and the open line section 16 can both extend in the internal hollow of the mast.

The ground-plane antenna according to the invention has improved performance, it can be mounted easily, offers a sufficient lightning protection and it has a constructional design with improved reliability with reduced inclination for getting broken, damaged or being covered with excessive ice, when these properties are compared to those of conventional ground-plane antennas.

Since the increased bandwidth is a result of the effect of the presence of the combined tapped line section, there will be no need any more of using a radiator with highly increased diameter to ensure the required bandwidth; thus the antenna structure will be surprisingly slender compared to its bandwidth which inherently means a reduced wind load and a decreased inclination for icing.

I claim:

1. Improved ground-plane antenna arrangement comprising:

a vertical resonant quarterwave radiating rod having an upper end and a lower end, said radiating rod being provided at least in part in the form of a hollow tube extending vertically upwardly from said lower end, an antenna base mechanically coupled to said lower end of the radiating rod and in the operational frequency, said base being electrically isolated from said lower end, a plurality of counterweight resonant rods extending from and connected with said antenna base and providing a virtual ground-plane for the radiating rod in the height of said base, an earthing rod having an upper end and a lower end, said earthing rod extending centrally in said hollow tube and being short-circuited at the upper end of said earthing rod with said tube, whereby a short-circuited coaxial line section shorter than the quarterwavelength is formed, a pair of input terminals adapted for respective connection to a coaxial feeding line having an inner conductor and an outer conductor, said terminals being respectively formed by said lower end of the radiating rod and by said base, a coaxial open line section having an inner conductor and an outer conductor, and further having an open end and a connected end, said connected end being connected across said input terminals in such a way that the outer conductor is connected to said base and the inner conductor is connected to said lower end of the radiating rod, said open line section forming an extension of said short-circuited line section and therewith providing a resonant combined line section such that the combined electrical length of the two line sections thereof is in the tolerance range of $\pm 25\%$ of the quarterwavelength, the input terminals forming tapping points of the so obtained resonant combined line section, whereby the susceptance of the combined line section measurable in the tapping point is capable of at least partially compensating the reactive component of the input impedance of the antenna.

2. Arrangement of claim 1, wherein said open line section is in the form of a coaxial cable.

3. Arrangement of claim 1, wherein a coaxial feeding line is provided having an inner conductor and an outer conductor, said base comprises a metal antenna head defining a central bore having a lower widened bore portion containing a shoulder therein, the lower end of the radiating rod and the lower end of the earthing rod extend downwardly through said bore and into said widened bore portion, a metal mounting disk is arranged in said widened bore portion in abutment with said shoulder and is connected to both the outer conductor of the coaxial open line section and the outer conductor of the coaxial feeding line and centrally thereof is also connected to the lower end of the earthing rod, a spacing sleeve is located on the lower end of the radiating rod for establishing an electrical isolation between the mounting disk and the radiating rod, a clamp is fastened to the lower end of the radiating rod in said widened bore portion and connected to both the inner conductor of the coaxial open line section and the inner conductor of the coaxial feeding line, and a support sleeve of insulating material is arranged in said bore to provide an outer support for the radiating rod.

4. Arrangement of claim 3, wherein the support sleeve is provided with an upper end which extends over the corresponding upper annular face of the antenna head in the vicinity of the bore thereat and a gap arrestor is fastened on the radiating rod above and adjacent to said upper end of the support sleeve.

5. Arrangement of claim 4, wherein a sealing bell is mounted on the radiating rod and arranged in engagement with the adjacent upper portion of the antenna head thereat.

* * * * *